US007913494B2

(12) United States Patent
Hiromitsu et al.

(10) Patent No.: US 7,913,494 B2
(45) Date of Patent: Mar. 29, 2011

(54) BURNER FOR COMBUSTION CHAMBER AND COMBUSTION METHOD

(75) Inventors: Nagayoshi Hiromitsu, Oume (JP); Jun Hosoi, Hamura (JP); Atsushi Fujii, Yokohama (JP); Tsukasa Saitou, Kawasaki (JP); Dirk Riechelmann, Yokohama (JP); Junichi Sato, Tokyo (JP)

(73) Assignee: Ishikawajima-Harima Heavy Industries Co., Ltd. (JP)

( * ) Notice: Subject to any disclaimer, the term of this patent is extended or adjusted under 35 U.S.C. 154(b) by 937 days.

(21) Appl. No.: 11/683,614

(22) Filed: Mar. 8, 2007

(65) Prior Publication Data

US 2007/0224562 A1 Sep. 27, 2007

(30) Foreign Application Priority Data

Mar. 23, 2006 (JP) ..... 2006-080881

(51) Int. Cl.
*F02C 1/00* (2006.01)
*F02G 3/00* (2006.01)

(52) U.S. Cl. ..... 60/748; 60/737; 239/399

(58) Field of Classification Search ..... 60/740, 60/742, 746, 747, 776, 748, 737; 239/399
See application file for complete search history.

(56) References Cited

U.S. PATENT DOCUMENTS 3,605,405 A * 9/1971 Du Bell ..... 60/737
3,703,259 A * 11/1972 Sturgess et al. ..... 239/400
3,946,552 A * 3/1976 Weinstein et al. ..... 60/743
4,023,351 A * 5/1977 Beyler et al. ..... 60/742
4,364,522 A * 12/1982 Reider ..... 239/399
5,123,248 A 6/1992 Monty et al. ..... 60/740
5,394,688 A * 3/1995 Amos ..... 60/39.23
5,444,982 A * 8/1995 Heberling et al. ..... 60/737
(Continued)

FOREIGN PATENT DOCUMENTS

CA 1 167 369 5/1984
(Continued)

OTHER PUBLICATIONS

Office Action issued on Mar. 4, 2009 on the counterpart Canadian Patent Application No. 2,581,429 (2 pages).

*Primary Examiner* — William H Rodríguez
(74) *Attorney, Agent, or Firm* — Ostrolenk Faber LLP

(57) ABSTRACT

A burner 1 for combustion chamber is provided with a cylindrical mixing portion 3 that mixes air for combustion (oxidizing agent) and fuel in the interior thereof and has one end 3*a* that opens to a combustion portion 2; a spray nozzle (fuel spraying portion) 5 that sprays fuel in the mixing portion 3, being disposed on another end 3*b* of the mixing portion 3; first blowing ports 6 that introduce the air for combustion to the mixing portion 3 to form a swirling flow with the fuel, being disposed to open to the inner wall of the mixing portion 3; and second blowing ports 7 that additionally introduce the air for combustion to the mixing portion 3, opening in a direction different from the first blowing ports 6 and being disposed further to the other end 3*b* side of the mixing portion 3 than the swirling flow. The burner for combustion chamber and combustion method of the present invention can shorten the flame length in the central axial direction by improving the combustion efficiency even during low loading and shorten the overall length of the burner for combustion chamber in the central axial direction.

4 Claims, 6 Drawing Sheets

U.S. PATENT DOCUMENTS

| | | | | |
|---|---|---|---|---|
| 5,490,378 | A * | 2/1996 | Berger et al. | 60/39.23 |
| 5,540,056 | A * | 7/1996 | Heberling et al. | 60/737 |
| 5,623,827 | A * | 4/1997 | Monty | 60/748 |
| 5,664,412 | A * | 9/1997 | Overton | 60/39.23 |
| 5,941,075 | A * | 8/1999 | Ansart et al. | 60/748 |
| 6,035,645 | A * | 3/2000 | Bensaadi et al. | 60/742 |
| 6,289,677 | B1 * | 9/2001 | Prociw et al. | 60/748 |
| 6,367,262 | B1 * | 4/2002 | Mongia et al. | 60/748 |
| 6,571,559 | B1 | 6/2003 | Fortuna et al. | 60/748 |
| 6,820,425 | B2 * | 11/2004 | David et al. | 60/743 |
| 6,834,505 | B2 * | 12/2004 | Al-Roub et al. | 60/737 |
| 6,983,599 | B2 * | 1/2006 | Young et al. | 60/722 |
| 7,114,337 | B2 * | 10/2006 | Cazalens et al. | 60/737 |
| 7,426,833 | B2 * | 9/2008 | Yoshida et al. | 60/737 |
| 7,610,759 | B2 * | 11/2009 | Yoshida et al. | 60/737 |
| 2003/0090409 | A1 | 5/2003 | Tokutsu et al. | |
| 2003/0131600 | A1 * | 7/2003 | David et al. | 60/737 |
| 2005/0044854 | A1 * | 3/2005 | Cazalens et al. | 60/740 |
| 2005/0223710 | A1 * | 10/2005 | Creighton et al. | 60/740 |
| 2006/0096296 | A1 * | 5/2006 | Held et al. | 60/776 |
| 2008/0236165 | A1 * | 10/2008 | Baudoin et al. | 60/746 |
| 2009/0255263 | A1 * | 10/2009 | Doerr et al. | 60/746 |

FOREIGN PATENT DOCUMENTS

| | | |
|---|---|---|
| EP | 0 728 989 | 8/1996 |
| EP | 0 833 107 | 4/1998 |
| EP | 1 314 933 | 5/2003 |
| EP | 1 600 693 | 11/2005 |
| JP | 2003-149337 | 5/2003 |
| JP | 2004-340416 | 12/2004 |
| JP | 2005-076989 | 3/2005 |

* cited by examiner

BURNER FOR COMBUSTION CHAMBER AND COMBUSTION METHOD

BACKGROUND OF THE INVENTION

1. Field of the Invention

The present invention relates to a burner for a combustion chamber that performs combustion by rapidly mixing fuel and an oxidizing agent such as air, and to a combustion method thereof.

Priority is claimed on Japanese Patent Application No. 2006-080881, filed Mar. 23, 2006, the content of which is incorporated herein by reference.

2. Description of Related Art

In recent years, there have been growing demands to reduce the concentration of nitrogen oxide (NOx) in the combustion exhaust of gas turbines and the like for the sake of environmental protection. In order to satisfactorily mix fuel and an oxidizing agent such as air, there has been proposed a burner having a cylindrical mixing portion in which fuel in a spray form and air for combustion, which is introduced from tangential to the cross section of the mixing portion, are introduced to generate a turbulent state by forming a strong swirling flow (refer, for example to Japanese Unexamined Patent Application No. 2005-76989). This burner for combustion realizes a reduction in NOx by rapidly mixing the fuel and air for combustion.

SUMMARY OF THE INVENTION

However, in the aforedescribed burner for combustion chamber and combustion method, a strong shearing area on the inner wall side of the mixing portion which causes flame extension and a rigid vortex area on the central axis side are formed by this strong swirling flow. Therefore, when the effect of the strong swirling flow is great, the strong swirling flow and the rigid vortex can end up being separated into a layer shape. In particular, in the case of a combustion chamber having a wide load range such as in an aircraft engine, when such a separation state occurs during a low load, the flame is formed only at the rigid vortex area, and the mixing of fuel and air therefore becomes insufficient, leading to a worsening of combustion stability and combustion efficiency. In such a case, ignition performance drops, and ignition at low temperatures becomes difficult.

The present invention was achieved in view of the above circumstances, and has as its object to provide a burner for combustion chamber and a combustion method that can shorten the flame length in the central axial direction of the burner for combustion chamber by improving the combustion efficiency even during low loading and shorten the overall length of the burner for combustion chamber in the central axial direction.

In order to achieve the aforementioned object, a first solving means according to the present invention adopts a burner for combustion chamber that is provided with: a cylindrical mixing portion that mixes an oxidizing agent and fuel in the interior thereof, with one end opening to a combustion portion; a fuel spraying portion that sprays fuel in the mixing portion, being disposed on another end of the mixing portion; first blowing ports that introduce the oxidizing agent to the mixing portion to form a swirling flow with the fuel, being disposed to open to the inner wall of the mixing portion; and second blowing ports that additionally introduce the oxidizing agent to the mixing portion, opening in a direction different from the first blowing ports and being disposed further to the other end side of the mixing portion than the swirling flow.

This invention can form a strong swirling flow of an air-fuel mixture consisting of fuel that is sprayed from the fuel spraying portion and the oxidizing agent that is introduced to the mixing portion from the first blowing ports. Also, by introducing the oxidizing agent into the mixing portion from the second blowing ports, it can be made to collide with the strong swirling flow. Thereby, a vortex breakdown can be caused by partially destroying the strong swirling flow. Accordingly, a stronger turbulence state can be formed than in the case of a strong swirling flow alone, thereby accelerating the mixture of the fuel and the oxidizing agent. At this juncture, the flammable zone in the combustion portion at the one end side of the mixing portion can be greatly expanded in the diameter direction by the moderate swirling that remains and the large turbulence. As a result, it is possible to shorten the distance between the combustion portion and the mixing portion.

Also, the second solving means according to the present invention adopts a burner for combustion chamber in which, in the first means described above, the first blowing ports open in the circumferential direction of the mixing portion; and the second blowing ports are provided to open in the central axial direction of the mixing portion, and are disposed further to the inside of the first blowing ports in the radial direction of the mixing portion.

In this invention, since the first blowing ports and the second blowing ports open in intersecting directions, when the oxidizing agent is introduced from both, it is possible to form an air-fuel mixture having large turbulence in the mixing portion and possible to quickly move the air-fuel mixture to the combustion portion quickly. Accordingly, occurrences of back firing and self ignition in the mixing portion can be suitably inhibited.

Also, the third solving means according to the present invention adopts a burner for combustion chamber in which, in the first means described above, the distal end of the fuel spraying portion is disposed projecting to the position of the first blowing ports along the central axis of the mixing portion.

In this invention, the strong swirling flow due to the oxidizing agent that is introduced from the first blowing ports collides with the distal end of the fuel spraying portion. Thereby, a strong shear flow can be formed around the fuel spraying portion. Accordingly, it is possible to produce greater turbulence, which can accelerate rapid mixing.

Also, the fourth solving means according to the present invention adopts a combustion method characterized by forming a swirling flow in a cylindrical mixing portion in which one end opens to a combustion portion, by mixing fuel that is sprayed from the other end side into the mixing portion and an oxidizing agent that is introduced into the interior of the mixing portion from a wall surface thereof, and additionally introducing the oxidizing agent into the mixing portion in a direction different from the swirling flow and from further to the other end side of the mixing portion than the swirling flow.

The present invention can shorten the flame length in the central axial direction of the burner for combustion chamber by improving the combustion efficiency even during low loading and can shorten the overall length of the burner for combustion chamber in the central axial direction.

DETAILED DESCRIPTION OF THE INVENTION

A first embodiment of the present invention will be described below with reference to FIGS. 1A to 3.

Figure 1A:
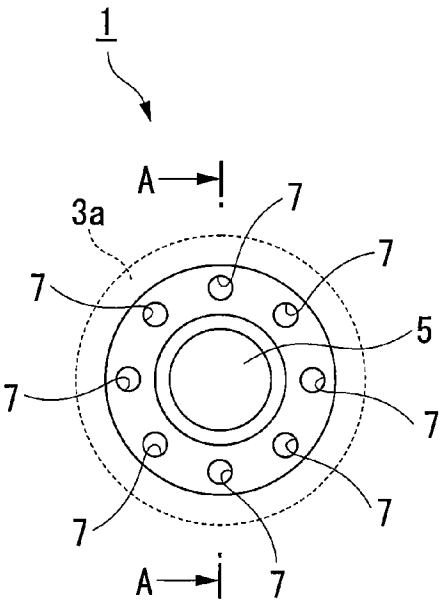
FIG. 1A is a back view of the mixing portion showing the burner for combustion chamber according to the first embodiment of the present invention.
Figure 1B:
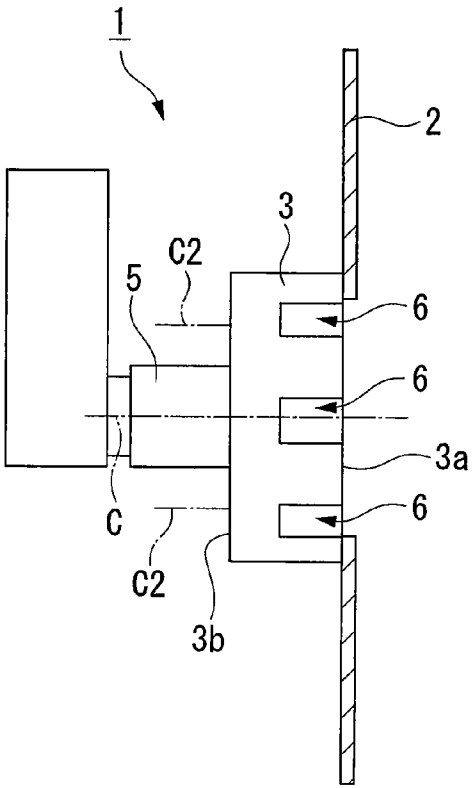
FIG. 1B is a side view of the mixing portion showing the burner for combustion chamber according to the first embodiment of the present invention.
Figure 1C:
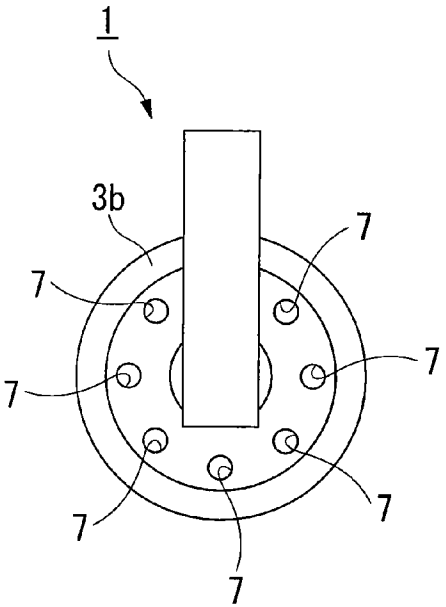
FIG. 1C is a front view of the mixing portion showing the burner for combustion chamber according to the first embodiment of the present invention.

As shown in FIGS. 1A, 1B, and 1C, a burner 1 for combustion chamber according to the first embodiment of the present invention is provided with the following: a cylindrical mixing portion 3 that mixes air for combustion (oxidizing agent) and fuel in the interior thereof, with one end 3*a* opening to a combustion portion 2; a spray nozzle (fuel spraying portion) 5 that sprays fuel in the mixing portion 3, being disposed on another end 3*b* of the mixing portion 3; a plurality of first blowing ports 6 that introduce the air for combustion to the mixing portion 3 to form a swirling flow with the fuel, being disposed to open to the inner wall of the mixing portion 3; and a plurality of second blowing ports 7 that additionally introduce the air for combustion to the mixing portion 3, opening in a direction different from the flow of the swirling flow and being disposed further to the other end 3*b* side of the mixing portion 3 than the first blowing ports 6.

The inner diameter of the mixing portion 3 is formed to be smaller than the inner diameter of the combustion portion 2.

Figure 2A:
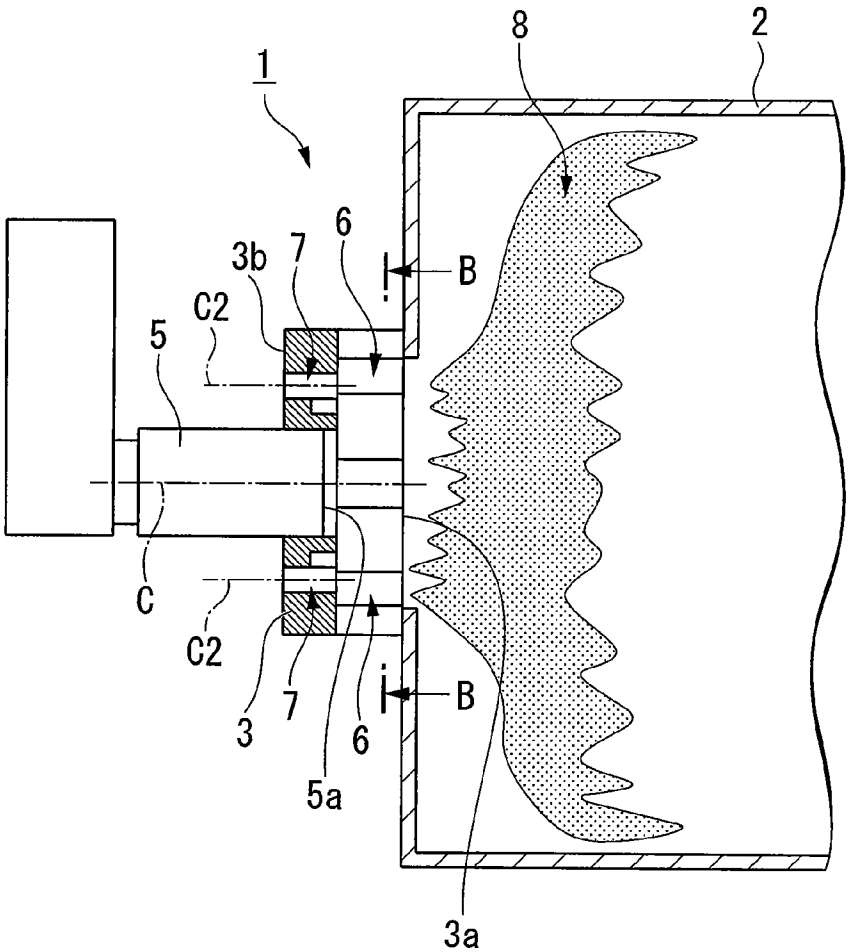
FIG. 2A is a sectional view along line A-A in FIG. 1A. (A portion corresponding to first blowing ports 6 is shown in a projection view.)
Figure 2B:
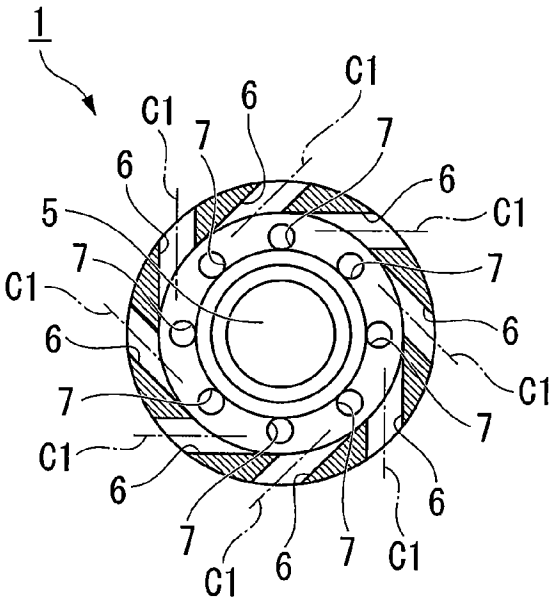
FIG. 2B is a sectional view along line B-B in FIG. 2A.
Figure 3:
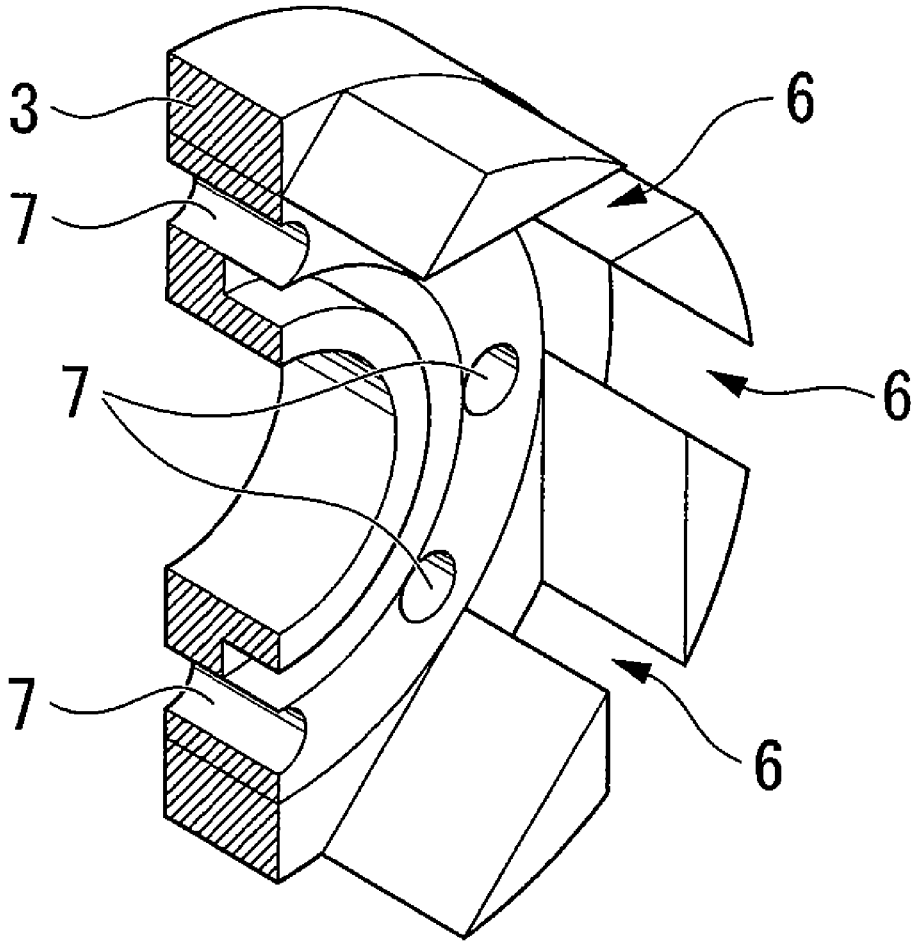
FIG. 3 is a partial sectional view showing the burner for combustion chamber according to the first embodiment of the present invention.

As shown in FIGS. 2A, 2B, and 3, the first blowing ports 6 are provided in a direction perpendicular to the central axis C of the mixing portion 3 and, by obliquely penetrating the wall surface of the mixing portion 3 while sloping in the radial direction with respect to the circumferential direction of the mixing portion 3, open to the interior of the mixing portion 3. The first blowing ports 6 are equally spaced in the circumferential direction of the mixing portion 3.

As shown in FIG. 2A, each of the second blowing ports 7 is provided extending along a central axis C2 which is parallel to the central axis C. The second blowing ports 7 are equally spaced from each other on same periphery of a circle around the central axis C of the mixing portion 3. The second blowing ports 7 are further to the inside of the first blowing ports 6 in the radial direction of the mixing portion 3, being disposed one-for-one for each first blowing port 6 at a position where the central axis C2 of the second blowing port intersects the central axis C1 of the first blowing port 6. The second blowing ports 7 are formed to open at both the one end 3*a* and the other end 3*b* of the mixing portion 3.

Next, the combustion method of the burner 1 for combustion chamber according to the present embodiment and the action and effect thereof will be described.

First, air for combustion is introduced from the first blowing ports 6 and the second blowing ports 7 into the mixing portion 3, and fuel in a spray form is injected into the mixing portion 3 from the spray nozzle 5.

At this time, the air for combustion that is introduced from the first blowing ports 6 flows across the inner wall surface of the mixing portion 3 in both a circumferential direction and an inward radial direction, so that a strong swirling flow is formed in the mixing portion 3. However, the air for combustion that is introduced from the second blowing ports 7 flows toward the combustion portion 2 in parallel with the central axis C to collide with the strong swirling flow. At this time, the strong swirling flow is partially destroyed to cause a vortex breakdown, with large turbulence being generated on the downstream side.

At this time, the mixture of the air for combustion and the fuel is rapidly performed by this large turbulence to produce a lean mixture that moves to the combustion portion 2. Here, since the swirling flow is not completely destroyed, the lean mixture abruptly expands in diameter in the combustion portion 2. Thus, the lean mixture comes to have a wide flammable zone, so that a large flame 8 is generated by ignition.

The burner 1 for combustion chamber and this combustion method can form a stronger turbulence state than in the case of forming only a strong swirling flow in the mixing portion, and therefore can rapidly accelerate the mixing of the fuel and the air for combustion. At this juncture, the flammable zone in the combustion portion 2 that is disposed downstream of the one end 3*a* of the mixing portion 3 can be greatly expanded in the diameter direction by the moderate swirling that remains and the large turbulence. Accordingly, it is possible to shorten the distance between the combustion portion 2 and the mixing portion 3.

By raising the combustion efficiency, the flame length in the mixing portion 3 can be shortened in the direction of the central axis C, and the overall length of the burner 1 for combustion chamber can be shortened in the direction of the central axis C.

Since the first blowing ports 6 and the second blowing ports 7 open in directions that mutually intersect, when the air for combustion is introduced from both, it is possible to form a lean mixture having large turbulence in the mixing portion 3 and possible to quickly move the lean mixture to the combustion portion 2. Accordingly, occurrences of back firing and self ignition in the mixing portion 3 can be suitably inhibited.

Next, a second embodiment shall be described with reference to FIGS. 4A and 4B.

In this embodiment, constituent elements identical to those in the first embodiment are identified with the same reference numbers, with explanations thereof omitted.

Figure 4A:
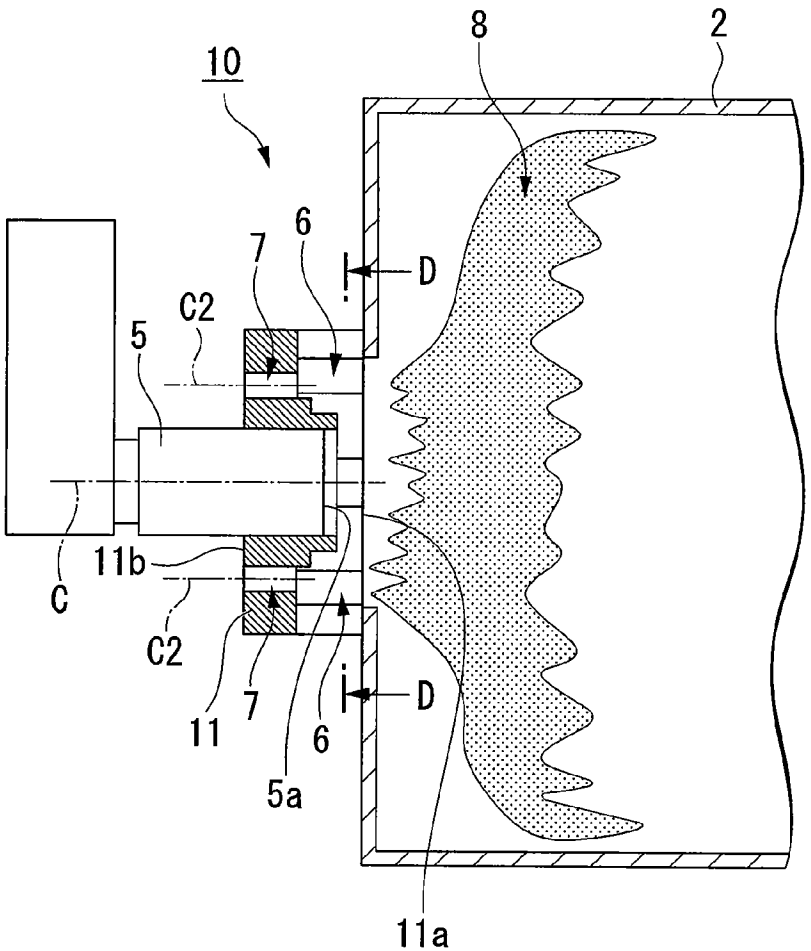
FIG. 4A is a sectional view of the position corresponding to the cross-section A-A of FIG. 1A showing the burner for combustion chamber according to the second embodiment of the present invention. (A portion corresponding to first blowing ports 6 is shown in a projection view.)
Figure 4B:
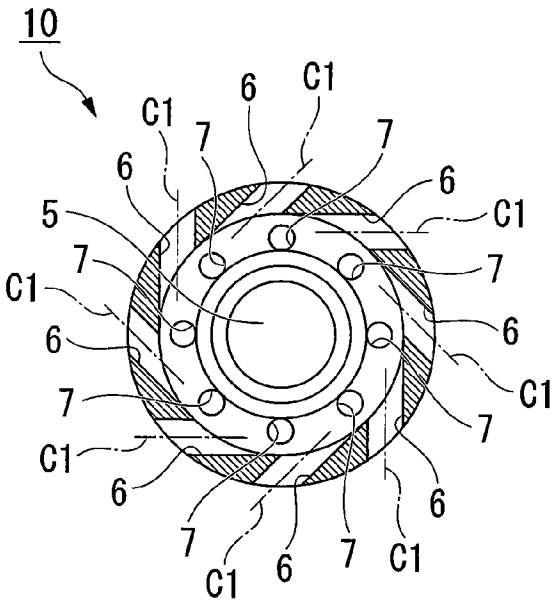
FIG. 4B is a sectional view along line D-D in FIG. 4A.

As shown in FIG. 4A, the point of difference of the second embodiment and the first embodiment is that a distal end 5*a* of the spray nozzle 5 in a burner 10 for combustion chamber according to the present embodiment is disposed projecting from another end 11*b* to the side of a distal end 11*a* of a mixing portion 11 along the central axis C until the disposed position of the first blowing ports 6.

The combustion method of this burner 10 for combustion chamber and the action and effect thereof shall be described.

First, air for combustion is introduced from the first blowing ports 6 and the second blowing ports 7 into the mixing portion 11, and fuel in a spray form is injected into the mixing portion 11 from the spray nozzle 5.

At this time, the strong swirling flow due to the air for combustion that is introduced from the first blowing ports 6 collides with the distal end 5*a* of the spray nozzle 5, so that a strong shear layer is produced in the mixing portion 11.

Since the air for combustion that is introduced from the second blowing ports 7 collides with this shear flow and the strong swirling flow due to the air for combustion that is introduced from the first blowing ports 6, greater turbulence is produced downstream of the first blowing ports 6 than in the first embodiment.

Thus, the mixture of the air for combustion and the fuel is rapidly performed. At this time, since the swirling flow is not completely destroyed similarly to the first embodiment, the lean mixture abruptly expands in diameter in the combustion portion 2.

The burner 10 for combustion chamber and the combustion method of this embodiment can more rapidly mix the fuel and the air for combustion than the burner 1 for combustion chamber and the combustion method of the first embodiment by more extensively destroying the strong swirling flow, and can more stably perform ignition at low temperatures and at low loads.

Figure 5A:
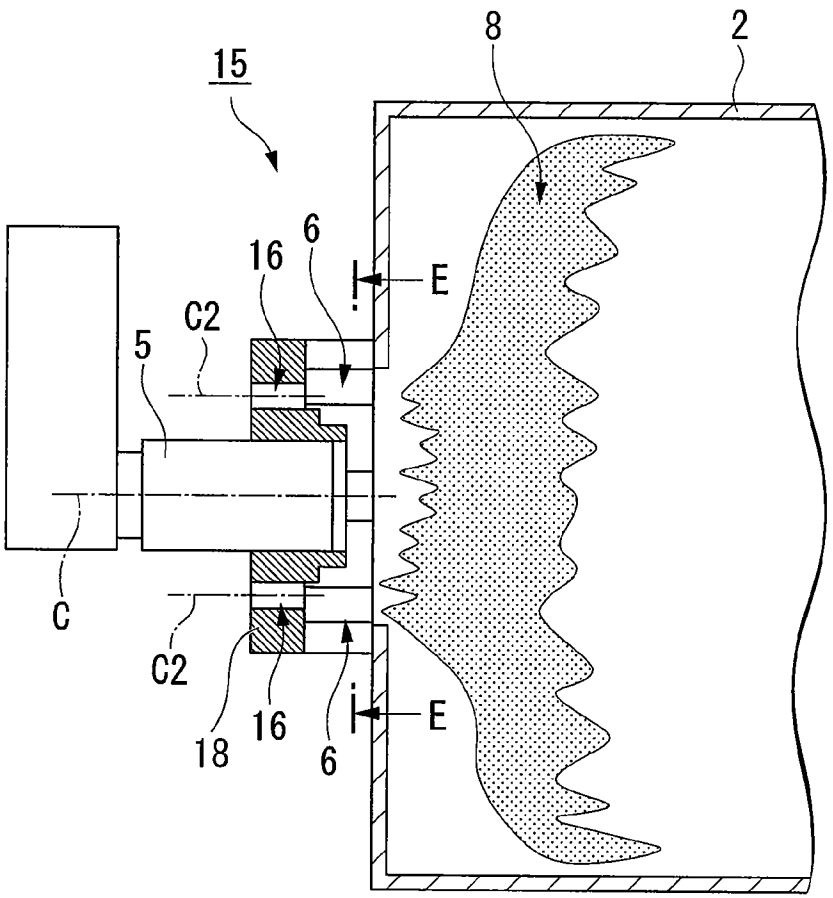
FIG. 5A is a sectional view of the position corresponding to the section A-A in FIG. 1A, showing the burner for combustion chamber according to the third embodiment of the present invention. (A portion corresponding to first blowing ports 6 is shown in a projection view.)

Next, a third embodiment will be described with reference to FIGS. 5A and 5B.

In this embodiment, constituent elements identical to those in the other embodiments described above are identified with the same reference numbers, with explanations thereof omitted.

Figure 5B:
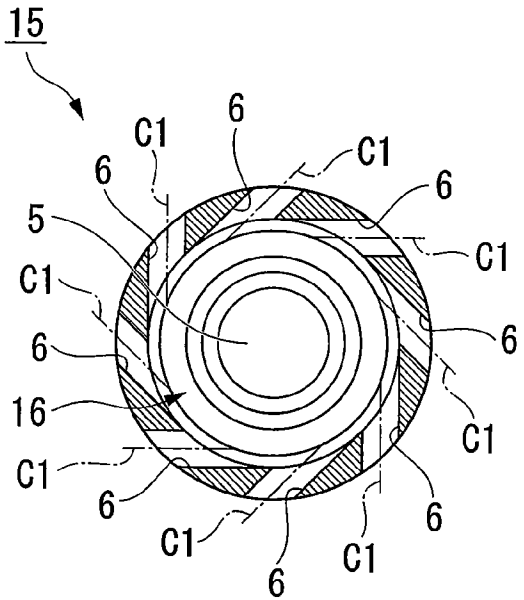
FIG. 5B is a sectional view along line E-E in FIG. 5A.

As shown in FIG. 5B, the point of difference of the third embodiment and the second embodiment is that a second blowing port 16 of a burner 15 for combustion chamber according to the present embodiment is formed as a circular slit.

The width of this second blowing port 16 is approximately the same as the inner diameter of the second blowing ports 7 according to the first and second embodiments, and is provided in a manner that makes the second blowing ports 7 continuous in the circumferential direction.

The outside diameter of a spray nozzle 17 is formed to be of a smaller diameter than the spray nozzle 5 according to the first and second embodiments, and the outside diameter of a mixing portion 18 is formed to be of a smaller diameter than the mixing portion 3 of the first embodiment and the mixing portion 11 of the second embodiment.

The burner 15 for combustion chamber can exhibit the same action and effect as the aforedescribed other embodiments. In particular, since the second blowing port 16 has a greater capacity than the second blowing ports 7 of the other embodiments, the flow rate of the air for combustion that is introduced to the mixing portion 18 can be made greater than in the other embodiments, and the flow distribution of the flow in the axial direction can be made greater than the flow in the radial direction. Accordingly, the outside diameter of the spray nozzle 17 and the mixing portion 18 can be reduced to achieve a reduction in weight.

While preferred embodiments of the invention have been described and illustrated above, it should be understood that these are exemplary of the invention and are not to be considered as limiting. Additions, omissions, substitutions, and other modifications can be made without departing from the spirit or scope of the present invention. Accordingly, the invention is not to be considered as being limited by the foregoing description, and is only limited by the scope of the appended claims. For example, the distal end 5*a* of the spray nozzle 5 is not restricted to the aforedescribed embodiments, so long as it is at a position that produces a collision with the air for combustion that is introduced from the first blowing ports 6.

Figure 6:
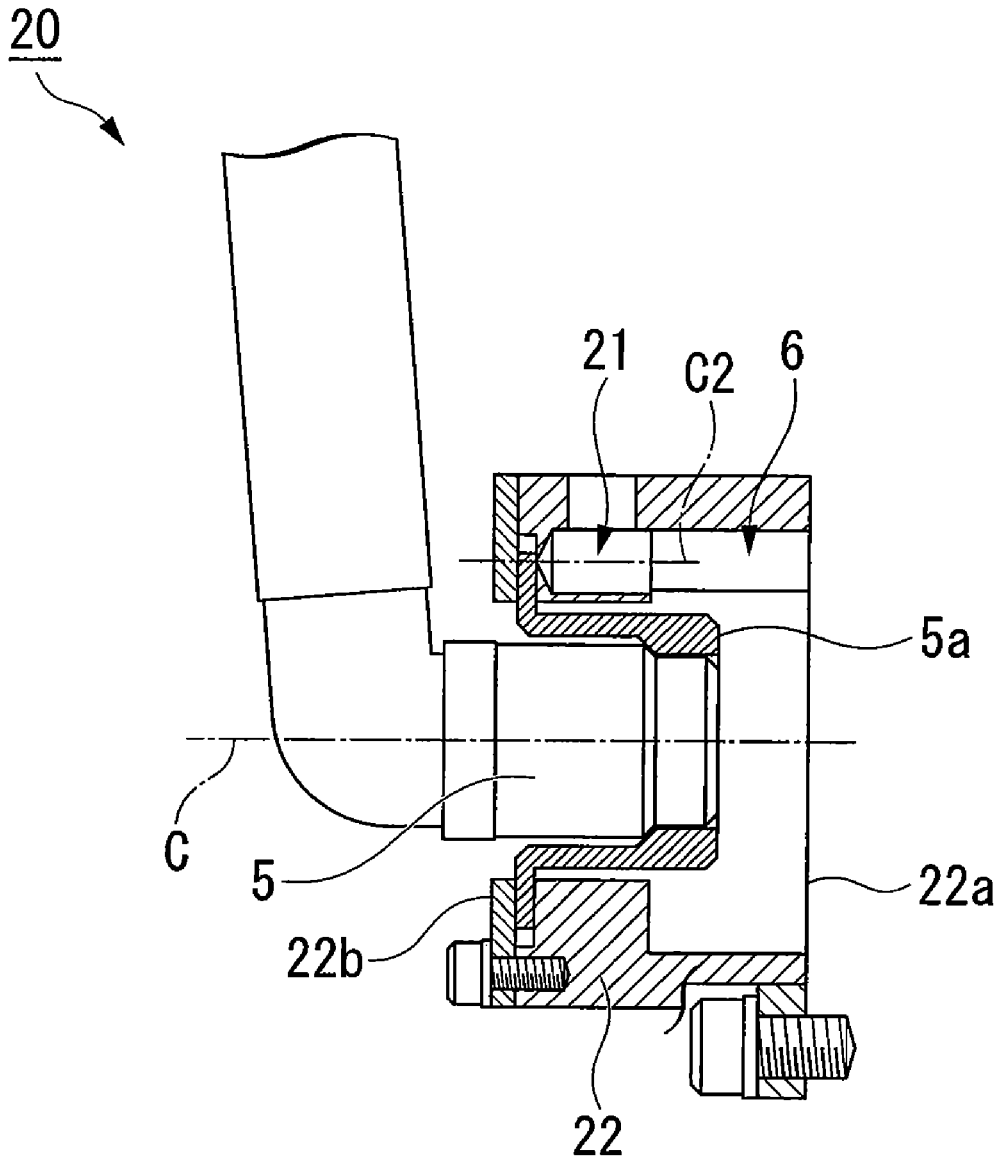
FIG. 6 is a sectional view of the position corresponding to the section A-A in FIG. 1A, showing the burner for combustion chamber according to the second embodiment of the present invention.

Also, as shown in FIG. 6, a second blowing port 21 of a burner 20 for combustion chamber, in addition to opening to one end 22*a* of a mixing portion 22, may be made to open to the outer circumferential surface of the mixing portion 22 instead of the side of the other end 22*b*. In this case, a mixing portion can be made taking into consideration the stress release of the spray nozzle 5.

In addition, the size of the second blowing port may be adjustable, with the second blowing port not having a central axis that is parallel to the central axis C but instead being formed to slope so as to have a central axis that intersects the central axis C at a predetermined angle.

When confirming the combustion efficiencies of the conventional burner for combustion chamber and the burner 10 for combustion chamber according to the second embodiment by actual combustion, the area of the flame generated in the combustion portion 2 could be expanded approximately three times with respect to the diameter in the visible region. Also, the length of the flame was reduced along the central axis of the burner and the combustion efficiency could be enhanced several percent accordingly.

What is claimed is:

1. A burner for a combustion chamber having a bottom surface, the burner comprising:

a cylindrical mixing portion having first and second ends and an inner wall defining an interior, the cylindrical mixing portion configured and operative to mix an oxidizing agent and fuel in the interior thereof, the first end opening to the combustion chamber;

a fuel spraying portion that sprays fuel in the cylindrical mixing portion, the fuel spraying portion being disposed on the second end of the cylindrical mixing portion;

first blowing ports having an inner surface, the first blowing ports configured and operative to introduce the oxidizing agent to the mixing portion to form a swirling flow with the fuel, the first blowing ports being disposed to open to the inner wall of the cylindrical mixing portion; and second blowing ports configured and operative to introduce the oxidizing agent to the mixing portion and to form turbulence by making the oxidizing agent collide with said swirling flow, the second blowing ports opening in a direction different from the first blowing ports and being disposed further to the second end of the cylindrical mixing portion than the swirling flow, wherein the first blowing ports and the combustion chamber are adjacent each other with said bottom surface of said combustion chamber interposed between the first blowing ports and the combustion chamber, and the bottom surface of the combustion chamber forms a part of the inner surface of the first blowing ports.

2. The burner for combustion chamber according to claim 1, wherein:

the first blowing ports open in a circumferential direction of the cylindrical mixing portion; and the second blowing ports are provided to open in a central axial direction of the cylindrical mixing portion, and are disposed further to an inside of the first blowing ports in a radial direction of the cylindrical mixing portion.

3. The burner for combustion chamber according to claim 1, wherein:

a distal end of the fuel spraying portion is disposed projecting to the position of the first blowing ports along a central axis of the cylindrical mixing portion.

4. A combustion method comprising:

providing a burner for a combustion chamber having bottom surface, with the burner having a cylindrical mixing portion with first and second ends and an inner wall defining an interior, the cylindrical mixing portion being configured and operative to mix an oxidizing agent and fuel in the interior thereof, the first end of the cylindrical mixing portion opening to the combustion chamber, the burner further having a fuel spraying portion being disposed on the second end of the cylindrical mixing portion, first blowing ports adjacent to said bottom surface of said combustion chamber interposed between the first blowing ports and the combustion chamber, the bottom surface of the combustion chamber forming part of the inner surface of the first blowing ports, the first blowing ports disposed to open to the inner wall of the cylindrical mixing portion, second blowing ports opening in a direction different from the first blowing ports and being disposed further to the second end of the cylindrical mixing portion than the first blowing ports;

forming a swirling flow in the cylindrical mixing portion by mixing fuel that is sprayed from the fuel spraying portion into the cylindrical mixing portion with an oxidizing agent that is introduced into an interior of the cylindrical mixing portion from the first blowing ports; and introducing additional oxidizing agent into the cylindrical mixing portion in a direction different from the swirling flow and from further toward the second end of the cylindrical mixing portion than the swirling flow, and forming turbulence by the collision of the additional oxidizing agent with the swirling flow.

* * * * *